United States Patent [19]

Torrini

[11] 4,312,632

[45] Jan. 26, 1982

[54] METHOD OF TANNING SKINS OR HIDES

[76] Inventor: Ottavio Torrini, Via A. Vespucci 40, Pontedera, Pisa, Italy, I-56025

[21] Appl. No.: 171,377

[22] Filed: Jul. 23, 1980

[30] Foreign Application Priority Data

Jul. 24, 1979 [IT] Italy ..... 9497 A/79

[51] Int. Cl.[3] ..... C14C 3/06

[52] U.S. Cl. ..... 8/94.27; 8/94.2; 8/94.33; 8/94.19 R

[58] Field of Search ..... 8/94.27, 94.33, 94.19 R, 8/94.2

[56] References Cited

U.S. PATENT DOCUMENTS

| | | | |
|---|---|---|---|
| 3,174,817 | 3/1965 | Spahrkas et al. | 8/94.26 |
| 3,253,879 | 5/1966 | Komarek et al. | 8/94.32 |
| 3,254,937 | 6/1966 | Komarek et al. | 8/94.26 |
| 3,519,378 | 7/1970 | Luck et al. | 8/94.26 |
| 4,126,413 | 11/1978 | Träubel et al. | 8/94.27 |

FOREIGN PATENT DOCUMENTS 2830991 3/1979 Fed. Rep. of Germany .

*Primary Examiner*—Maria Parrish Tungol

[57] ABSTRACT

The tanning of hides or skins using chromium salts is carried out in a tanning drum by using a total liquid phase less than or substantially equal to the amount of liquid imbibed in the hides or skins in the pelt state. Lubricants can be added to reduce friction between the skins and hide, and between the skins and hides and the drum. An absorbent such as wood flour can be added to absorb residual bath solution.

7 Claims, No Drawings

METHOD OF TANNING SKINS OR HIDES

FIELD OF INVENTION

In conventional tanning techniques using basic chromium salts in rotating drums, cowhides and animal skins in general are brought to the pelt stage beforehand by means of several chemical processes (soaking, dehairing, bating, pickling) and machanical processes (fleshing, splitting), before passing to the actual operation of chrome tanning.

DESCRIPTION OF THE PRIOR ART

In the chrome tanning method, treatment in the drum is usually carried out in a bath solution, using a variable quantity of water. It is considered that fairly large quantities of water are indispensible, not only to facilitate sliding or rolling of the skins during rotation of the drum, but also to obtain better stretching of the skins treated, thereby favouring the dissolving of the chromium tanning salts, basifying salts and other products such as masking agents etc., which are usually necessary for completing tanning.

Conventional tanning in a relatively abundant bath solution involves the discharge of the latter and/or allowing the solution to drip from the skins at the end of the tanning process. The residual bath solution is far from completely used and still contains quantities of chromium salts in solution which find their way into the natural environment when the bath solution is discharged directly into the drainage system of the tannery.

In order to prevent the residual bath solution from finding its way into the environment, it is necessary for it to be collected in containers and then treated by chemical and physical means for the recovery of the chromium in any form. All of this involves the use of equipment, personnel, time and money.

The possible use in tanning of recovered products which contain chromium in any form gives rise to further technical and financial problems which must be solved for the recovered products to be reconditioned.

SUMMARY OF THE INVENTION

It is an object of the invention to provide a method of chrome tanning of skins which leaves little or no residual tanning solution at the end of the tanning process.

It is another object of the invention to provide a method wherein all or almost all of the tanning salt is absorbed, thus avoiding any wastage of the same.

A further object is to ensure optimum conditions for a fast and thorouth tanning process.

A further object is to form a highly concentrated solution of the chromium salts in liquid imbided in the skins so as to favour a high rate of diffusion of the tanning agent in the skin. The high concentration of the solution furthermore has the effect of slowing down the hydrolysis of the basic chromium salts and therefore does not favour an increase in size of the molecules of the tanning agent, as a result of which, at a suitably low pH value, the initial tanning effect is always slight, even when using chromium salts with a basicity greater than 33.3° C. Schoerlemmer.

DESCRIPTION OF THE INVENTION

In the preferred method of invention, the chrome tanning of skins is characterized in that the treatment in the tanning barrel takes place with a total liquid phase not substantially in excess of the liquid imbibed in the skins in the pelt state. The chromium salts used in the tanning process are preferably introduced into the drum in a dry state.

The low volume of liquid causes a considerable amount of friction between the skins and against the walls of the drum due to the rotation of the drum itself; this, in turn, gives rise to an automatic and gradual increase in the temperature during tanning, to over 40° C., together with an increase in the aggregation i.e. linking of several chromium atoms and a subsequent improvement in the fixing effect of the tanning agent to the skin (thereby resulting in a considerable decrease in the amount of chromium in the skin in extractable form). The method of tanning skins with the aid of only the liquid imbibed in the skins or an equivalent volume makes it possible to avoid the discharge of residual liquid; the quantity of the latter is so small that, at the end of tanning, it can be removed in the drum with the aid of a small quantity of a suitable absorbent substance.

Alternatively the chromium salt can be introduced in the form of a concentrated solution. In the latter case before addition of the chromium salt solution, the pickling bath solution can be removed to compensate for the introduction into the drum of the solvent liquid, and, if necessary, the amount of absorbent product used for absorbing residual liquid at the end of the process is increased.

Hence it can be seen that advantages of the invention include on the one hand, fast rate of tanning, thoroughness of tanning, and full use of the tanning agent; on the other hand, no discharge of the liquid at the end of tanning; in conclusion a highly economical and hygienic method.

The method of chrome tanning as described above can be put into practice by adopting certain preferred measures and precautions as follows.

In order to protect the grain layer and in order to limit to working values the friction of the skins between themselves and against the walls of the drum, the sliding of the skins during rotation of the drum is obtained by using fatty substances of natural or synthetic origin which are improved if combined with a surface-active agent with an additional greasing effect. Suitable in this respect are inoxidizable oils which are stable in the presence of acid pH, electrolytes and mineral tanning agents and which are able to lubricate the surfaces of the skins without causing, in time, fatty exudations. A surface-active agent which is suitable and compatible with all of the other products present in the tannage is sodium lauryl ether sulphate oxyethlate.

The absorbtion of the residual liquid at the end of tanning which avoids dripping of liquid from skins when supported on a beam, is achieved using wood flour or a similar product which is introduced into the drum at the end of the tanning process and dispersed by rotating the drum for approximately 30 minutes.

White-wood flour with a very fine grain (type "200"), and in a quantity between 0.5% and 3.0% or more preferably 0.5% and 1.1% of the weight of the pelt skins has normally been found to be suitable.

The chromium salts most suited for the tanning method in question are basic chromium salts in the form of an industrial powder of a basicity of 33.3° or 50°, or with a theoretical basicity of 66.6° Schoerlemmer (these last-named salts are so called "autobasifying" salts), or with a basicity between the above mentioned values.

As stated above the tanning method of the invention can also be performed by using concentrated solution of chromium salts with various basicities and in various concentrations. In such a case, the pickling bath solution must be removed or reduced in order to compensate for the introduction into the drum of the solvent liquid and, if necessary, the quantity of the absorbent product is increased.

Both in the case where mineral tanning agent is powdered form is used and in the case where a mineral tanning agent in solution form is used, products which are poor in neutral salts are to be preferred, because they permit a limitation of seline efflorescent whilst the tanned skins are resting on the beam.

The invention will be further described by reference to some examples.

EXAMPLES

Operations for preparing the skins for tanning, such as soaking, liming, bating, deliming and pickling are performed. In order to protect the skin from mould, a product with optimum fungicidal and bactericidal properties should be added to the pickling bath solution. Fungicides added to the mineral tanning agent can also be used;

In order to initially make the tanning effect of the chromium salt still weaker it is necessary to perform a slight "masking" using suitable organic and inorganic salts (for example such as sodium formate, sulphite, acetate, phthalate, and the like, mixed or unmixed); this produces a smooth grain and a more even deposition of the tanning agent.

A mixture of masking salts found to be suitable consists of 60 parts by weight of sodium formate (or sulphite) and 40 parts by weight of sodium acetate.

A slow or delaying action basifying agent which can be employed in the tanning process is dolomite; other products such as calcium carbonate, magnesite, and the like can also be used.

The chemical neutralization phase of chromium skins by means of organic or inorganic products having an alkaline reaction can cause the so called "bleeding" due to chromium compounds unlinked to collagen. In order to prevent or minimize "bleeding" it is preferable to effect neutralization without washing beforehand, at a temperature of 30° C.–37° C., using products which produce neutralizing buffer solutions.

Aluminium basic salts, employed with chromium salts, or for partly replacing said salts, can also help for a better fixing of chromium to collagen.

The right value of the final tanning pH assists for a higher fixing of chromium to collagen.

Three practical examples of chromium tanning procedure for calfskins, without residual bath according to the invention are given below:

(A)—of a powder chromium basic salt at 33.3° Sch. and about 25% of chromium sesquioxide;

(B)—of a powder chromium basic salt at 50 Sch. and about 30% of chromium sesquioxide;

(C)—of a powder chromium basic salt at 66.6° Sch. and about 21% of chromium sesquioxide;

| | | A | B | C |
|---|---|---|---|---|
| pH of the conventional pickling bath (effected with the known products: NaCl, HCOOH, $H_2SO_4$) | approx. | 3–3.2 | 2.8–3 | 2.6–2.8 |
| pickling bath density | approx. | 7°–8°Bé | 7°–8°Bé | 7°–8°Bé |
| antimould product added to pickling bath | approx. | 0.15% | 0.15% | 0.15% |
| the drum is rotated for | approx. | 30′ | 30′ | 30′ |
| The pickling bath solution is removed. Time required such that only the liquid absorbed by the skins is left: | circa | 60′–120′ | 60′–120′ | 60′–120′ |
| The following products, referred to the pelt weight of the skins, are then introduced into the drum without being dissolved beforehand: | | | | |
| (a) Basic chromium salts | circa | 7% | 7% | 7% |
| (b) Masking product (60 pp NaCOOH and 40 pp sodium acetate) | circa | 0.6% | 0.2% | — |
| (c) Oil with characteristics described above | | 0.5%–0.7% | 0.5%–0.7% | 0.5%–0.7% |
| (d) Surface-active agent with an additional greasing effect | circa | 0.15% | 0.15% | 0.15% |
| The drum is restarted and made to rotate, at a speed of 4–8 revolutions per minute, depending on circumstances, for approx.: | | 2 hours | 2 hours | 6 hours |
| Once the drum has stopped dolomite is added as a slow-action basifying agent | circa | 1% | 0.2% | — |
| The drum is then rotated again for approx.: | | 4 hours | 4 hours | — |
| If stoppages during opera- | | | | |

-continued

| | | A | B | C |
|---|---|---|---|---|
| tion are possible, at this point the drum can be left to rest for: | | 10–12 hours | 10–12 hours | 3–10 hours |
| After which the white-wood flour is added | | 1% | 1% | 1% |
| And the drum is rotated slowly so as to achieve a suitable distribution of the absorbent agent, for: | circa | 30′ | 30′ | 30′ |
| The final tanning pH is: (for a higher final tanning pH, a different quantity of dolomite must be used or the pH of the pickling bath solution changed.) | circa | 3.8–4 | 3.8–4 | 3.8–4 |

The skins which have been tanned, in accordance with examples A, B and C, can be removed from the drum and, before being left to rest on a beam for 48 hours, can be prepared for the subsequent processing stages.

It can be noted at this point that, after the skins have been left to rest on the beam for 48 hours, the quantity of white-wood flour used in the drum as an absorbent for the residual humidity is left behind on the skins, has lost the humidity absorbed and has returned to its original colour.

The mechanical stage of pressing the chrome skins, subsequent to tanning, involves the draining off of liquid still containing, amongst other things, a variable quantity of trivalent chromium. This liquid can be profitably absorbed using powder or shavings which result from the dehairing of chrome skins and are by-products of tanning of the skins, these products having their own uses and applications.

What is claimed is:

1. A method of final tanning skins or hides in a tanning drum using chromium salts, wherein the total liquid phase contained in the tanning drum is less than or substantially equal to the amount of liquid contained in the skins or hides in their pelt state; said method further comprising the addition to the tanning drum, subsequent to tanning, of wood flour in an amount equal to about 0.5% to 3% of the pelt weight of said skins or hides; said wood flour functioning to absorb any residual liquid remaining in the tanning drum upon completion of tanning.

2. A method of tanning as defined by claim 1, wherein the chromium salts are introduced into the tanning drum in a dry state.

3. A method of tanning as defined by claim 1, wherein the chromium salts are introduced into the tanning drum in the form of a concentrated solution.

4. A method of tanning as defined by claim 3, wherein the volume of a pickling bath solution imbided in the skins is reduced before addition of the concentrated solution of chromium salts.

5. A method of tanning as defined by claims 2 or 4, wherein fatty substances of natural or synthetic origin are added with the chromium salts to limit friction between the skins or hides and between the skins or hides and the tanning drum.

6. A method of tanning as defined by claim 5, wherein a surface-active agent is added.

7. A method of tanning as defined by claim 6, wherein the surface-active agent is sodium lauryl ether sulphate oxyethylate.

* * * * *